US008544403B2

(12) United States Patent
Åstrand

(10) Patent No.: US 8,544,403 B2
(45) Date of Patent: Oct. 1, 2013

(54) FLOATING UNIT

(75) Inventor: Daniel Åstrand, Göteborg (SE)

(73) Assignee: GVA Consultants AB, Gothenburg (SE)

( * ) Notice: Subject to any disclaimer, the term of this patent is extended or adjusted under 35 U.S.C. 154(b) by 185 days.

(21) Appl. No.: 13/019,777

(22) Filed: Feb. 2, 2011

(65) Prior Publication Data

US 2011/0192336 A1 Aug. 11, 2011

Related U.S. Application Data

(60) Provisional application No. 61/301,673, filed on Feb. 5, 2010.

(30) Foreign Application Priority Data

Feb. 5, 2010 (SE) ..... 1050112

(51) Int. Cl.
*B63B 21/00* (2006.01)

(52) U.S. Cl.
USPC ..... 114/230.2

(58) Field of Classification Search
USPC ..... 114/230.1, 230.2, 230.21, 230.22, 114/230.23, 230.26, 230.27, 244, 246, 293
See application file for complete search history.

(56) References Cited

U.S. PATENT DOCUMENTS

| | | | | |
|---|---|---|---|---|
| 5,222,453 | A * | 6/1993 | Chabot | 114/230.22 |
| 5,390,618 | A * | 2/1995 | Wolff et al. | 114/230.23 |
| 5,816,182 | A | 10/1998 | Pollack | |
| 6,651,580 | B2 * | 11/2003 | Lay et al. | 114/293 |
| 6,983,714 | B2 * | 1/2006 | Dove et al. | 114/293 |
| 7,392,757 | B2 * | 7/2008 | Niebur | 114/200 |
| 2003/0159638 | A1 | 8/2003 | Lay et al. | |
| 2005/0022712 | A1 | 2/2005 | Gundersen | |
| 2008/0121163 | A1 * | 5/2008 | Keener | 114/264 |

OTHER PUBLICATIONS

US Dept of Navy, Chain Locker Effluent Draft Discharge Assessment Report, EPA-842-D-06-014, Jun. 2003, p. 3.*

* cited by examiner

*Primary Examiner* — Stephen Avila
*Assistant Examiner* — Andrew Polay
(74) *Attorney, Agent, or Firm* — Gary M. Machetta

(57) ABSTRACT

The present invention relates to a unit adapted to float in a body of water with a sea bed. The unit comprises a station-keeping system comprising a mooring line, the mooring line comprising a connection portion and a tail portion and when the unit is floating. The body of water reaches a still water line of the unit and the connection portion extends from the sea bed to a mooring line handling arrangement of the unit. The arrangement is adapted to actively alter the length of the connection portion. When the mooring line is in a permanent mooring position, at least a portion of the tail portion is located in the body of water.

18 Claims, 10 Drawing Sheets

FLOATING UNIT

CROSS REFERENCE TO RELATED APPLICATIONS

This application claims the benefit of U.S. Provisional Patent Application having Ser. No. 61/301,673, flied on Feb. 5, 2010 and Swedish Patent Application having Serial No. SE 1050112-0, filed on Feb. 5, 2010. Both applications are incorporated by reference herein.

TECHNICAL FIELD

The present invention relates to a unit adapted to float in a body of water in accordance with the preamble of claim 1. Moreover, the present invention relates to a unit adapted to float in a body of water in accordance with the preamble of claim 7. Further, the present invention relates to a method for obtaining a permanent station-keeping system for a unit floating in a body of water in accordance with the preamble of claim 13.

BACKGROUND OF THE INVENTION

A unit adapted to float in a body of water, in particular a unit for drilling for or production of natural resources such as hydrocarbons, is generally provided with a station-keeping system in order to maintain the geographical position of the unit. Such a station-keeping system may comprise one or more mooring lines and/or a dynamic positioning system which in turn comprises a plurality of thrusters.

A unit with a station-keeping system comprising a mooring line generally has a mooring line handling arrangement, comprising inter alia a windlass and/or a chain jack, such that the length of the portion of the mooring line extending between the unit and the sea bed—which portion hereinafter is referred to as the connection portion—may be altered. Such an alteration may for instance be occasioned by the fact that the position of the unit needs to be changed. A tail portion of the mooring line, i.e. a portion of the mooring line which is located on the opposite side of the handling arrangement as compared to the connection portion, is generally stored onboard the unit. For instance, the tail portion may be stored in a chain pipe and/or a chain locker of the unit.

However, there are problems related to the onboard storage of the tail portion. For instance, since the tail portion generally has a substantial weight, the onboard storage will contribute to an increase of the vertical centre of gravity (VCG) of the unit which in turn will impair the load carrying capacity of the unit. Moreover, if the unit is in a damaged condition such that the unit is subjected to a large inclination, there is a risk that the chain pipe and/or chain locker may be filled with sea water which results in an even larger inclination of the unit.

In order to solve the latter problem, US 2005/0022712 proposes the use of a sealing device for providing a seal between the tail portion and a chain pipe. Although the '712 solution in many cases is appropriate in terms of avoiding the additional inclination during a damaged condition, the problem of the increased VCG is not solved by the '712 solution.

As may be realized from the above, there is a need for improvements of units comprising mooring lines.

SUMMARY OF THE INVENTION

A first object of the present invention is to provide a unit adapted to float in a body of water, wherein the storage of a tail portion of at least one mooring line of the unit affects the stability, in particular the damage stability, of the unit to a less adverse extent as compared to a unit with a traditional mooring storage system.

A second object of the present invention is to overcome or ameliorate at least one of the disadvantages of the prior art, or to provide a useful alternative.

At least one of the aforementioned objects is achieved by a marine structure according to claim 1.

As such, the present invention relates to a unit adapted to float in a body of water with a sea bed. The unit comprises a station-keeping system comprising a mooring line, the mooring line comprising a connection portion and a tail portion and when the unit is floating, the body of water reaches a still water line of the unit and the connection portion extends from the sea bed to a mooring line handling arrangement of the unit. The arrangement is adapted to actively alter the length of the connection portion.

As used herein, the expression "mooring line handling arrangement" encompasses any arrangement adapted to actively alter the length of the connection portion. Purely by way of example, such an arrangement may comprise a windlass and/or a chain jack. If the arrangement comprises a plurality of windlasses and/or chain jacks, the tail portion of the mooring line is considered to begin at the last one of this plurality, following the mooring line in a direction from the sea bed towards the unit.

According to the present invention, when the mooring line is in a permanent mooring position, at least a portion of the tail portion is located in the body of water.

As used herein, the expression "permanent mooring position" relates to a position in which the mooring line is intended to be during a permanent condition of the station-keeping system as well as a permanent, e.g. survival or operational, condition of the unit. As such, an installation position of the mooring line, e.g. during tensioning of the line, is not to be regarded as falling within the above definition of a permanent mooring position. Moreover, according to the above definition, a mooring line may not be regarded as being in a permanent mooring position when the unit is in a damage condition since a damage condition is not regarded as a permanent condition for the unit.

Thus, the unit according to the above means that the VCG of the unit may be decreased, i.e. lowered, as compared to a unit with a traditional tail portion storage arrangement. This is since the above unit provides for at least a portion of the tail portion possibly being located at a low elevation; in some embodiments of the present invention a portion of the tail portion may in fact be located beneath the keel of the unit.

According to a preferred embodiment of the present invention, the tail portion comprises a tail portion end at which the tail portion terminates. Moreover, when the mooring line is in a permanent mooring position, the tail portion end is located in the body of water, above the sea bed.

According to another embodiment of the present invention, the unit further comprises a cavity through which at least a portion of the tail portion extends when the unit is floating.

According to a further embodiment of the present invention, the mooring line handling arrangement is at least partially located below the still water surface.

The above location of the mooring line handling arrangement may result in a low point of application of the load of the mooring line which in turn may result in a low VCG, a consequence of which is that the load carrying capacity of the unit may be increased.

According to another embodiment of the present invention, the unit comprises a chaser adapted to travel on the connection portion, at least a portion of the tail portion being attached to the chaser.

By using a chaser, the position of the tail portion may be controlled such that e.g. unwanted swinging of the tail portion is reduced and in some implementations even avoided.

According to another embodiment of the present invention, the unit comprises a float adapted to be located under the still water surface, the unit further comprising a plurality of support columns each one of which extending from the float and being adapted to intersect the still water surface.

A second aspect of the present invention relates to a unit adapted to float in a body of water with a sea bed and when the unit is floating, the body of water reaches a still water line of the unit. The unit comprises a mooring line handling arrangement adapted to handle at least one mooring line for the purpose of station-keeping of the unit, the arrangement being adapted to actively interact with the mooring line such that a connection portion of the mooring line extends from the arrangement to the sea bed whereas a tail portion of the mooring line is located on the opposite side of the arrangement as compared to the connection portion. The unit comprises a cavity adapted to receive at least a portion of the tail portion through a cavity inlet.

According to the second aspect of the present invention, the cavity further comprises a cavity outlet providing fluid communication between the cavity and the environment ambient of the unit.

According to a preferred embodiment of the present invention, the cavity outlet is located below the still water surface.

According to another embodiment of the present invention, the cavity forms an integral part of the outer skin of the unit.

According to a further embodiment of the present invention, the unit comprises a float adapted to be located under the still water surface, the unit further comprising a plurality of support columns each one of which extending from the float and being adapted to intersect the still water surface. The cavity is at least partially comprised in at least one of the support columns.

According to another embodiment of the present invention, the cavity further extends through at least a portion of the float.

According to a further embodiment of the present invention, the unit comprises the mooring line, the unit further comprising a chaser adapted to travel on the connection portion, at least a portion of the tail portion being attached to the chaser.

A third aspect of, the present invention relates to a method for obtaining a permanent station-keeping system for a unit floating in a body of water, the body of water comprising a sea bed. The unit comprises a mooring line handling arrangement adapted to handle at least one mooring line for the purpose of station-keeping of the unit.

The method according to the third aspect of the present invention comprises the steps of:

connecting a portion of a mooring line to the sea bed;

connecting the mooring line to the mooring line, handling arrangement such that a connection portion of the mooring line is obtained between the mooring line handling arrangement and the sea bed and a tail portion of the mooring line is obtained on the opposite side of the mooring line handling arrangement as compared to the connection portion, and arranging the tail portion in a permanent storage position such that at least a portion of the tail portion is located in the body of water.

BRIEF DESCRIPTION OF THE DRAWINGS

The present invention will hereinafter be further explained by means of non-limiting examples with reference to the appended drawings wherein.

DETAILED DESCRIPTION OF PREFERRED EMBODIMENTS

The invention will be described using examples of embodiments. It should however be realized that the embodiments are included in order to explain principles of the invention and not to limit the scope of the invention, defined by the appended claims.

Figure 1:
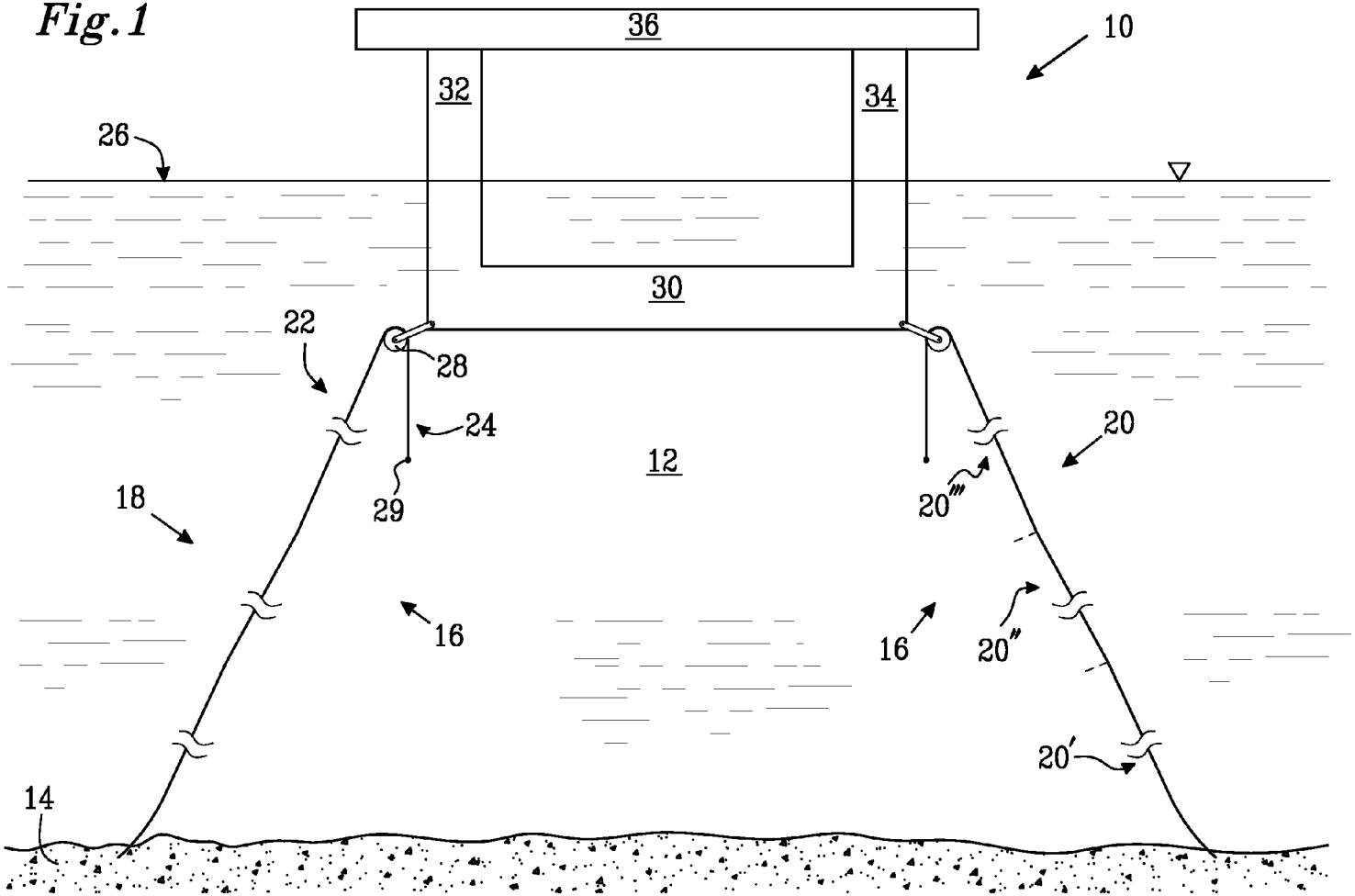
FIG. 1 is a schematic side view of a unit according to the present invention.

FIG. 1 illustrates a unit 10 adapted to float in a body of water 12 with a sea bed 14. For the sake of simplicity, reference is made to "sea bed" irrespective of whether the body of water 12 is a region of an ocean, sea, lake or river. The unit 10 comprises a station-keeping system 16 comprising a first mooring line 18. Moreover, the FIG. 1 station-keeping system comprises a second mooring line 20. It should be noted that the station-keeping system 16 may comprise a plurality of mooring lines, in some cases up to 20 or 30 mooring lines although only two mooring lines are illustrated in FIG. 1. Moreover, in addition to the aforesaid mooring lines, the station-keeping system may comprise propulsion assemblies (not shown in FIG. 1), such as thrusters.

Each mooring line 18, 20 may comprise a wire segment, a chain segment or a combination of wire and chain segments. Preferably, a chain segment as well as a wire segment is at least partially made of metal, such as steel. The implementation of the second mooring line 20 illustrated in FIG. 1 comprises a bottom chain segment 20', a top chain segment 20''' and a wire segment 20'' extending from the bottom chain segment 20' to the top chain segment 20'''. The first mooring line 18 comprises the same three segment types. The above implementations of the first and second mooring lines 18, 20 are preferred implementations for all the embodiments of the present invention, in particular for the embodiments of the present invention presented hereinbelow.

Moreover, FIG. 1 illustrates that the mooring line 18 comprises a connection portion 22 and a tail portion 24 and, when the unit 10 is floating, the body of water 12 reaches a still water line 26 of the unit 10 and the connection portion 22 extends from the sea bed 14 to a mooring line handling arrangement 28 of the unit 10. The handling arrangement 28 is adapted to actively alter the length of the connection portion 22. As previously discussed, the handling arrangement 28 may comprise a windlass and/or a chain jack. In the implementation of the handling arrangement 28 illustrated in FIG. 1, the handling arrangement 28 comprises a windlass.

FIG. 1 further illustrates that, when the mooring line 18 is in a permanent mooring position, at least a portion of the tail portion 24 is located in the body of water 12. In the embodiment illustrated in FIG. 1, the whole tail portion 24 is located in the body of water. It should be noted that the tail portion 24 may preferably comprise, and may preferably in many implementations be constituted by, a chain segment.

FIG. 1 further illustrates that the tail portion 24 comprises a tail portion end 29 at which the tail portion 24 terminates and that the tail portion end 29 is located in the body of water 12, above the sea bed 14. Moreover, in the embodiment of the present invention illustrated in FIG. 1, the mooring line handling arrangement 28—which in this case is the windlass—is at least partially located below the still water surface 26. In the FIG. 1 embodiment, the windlass is completely located below the still water surface 26.

The FIG. 1 unit 10 is a so called semi-submersible unit 10 comprising a float 30 adapted to be located under the still water surface 26. Moreover, the FIG. 1 unit 10 comprises a plurality of support columns, wherein only two of the support columns 32, 34 are visible in FIG. 1, each one of which extends from the float 30 and is adapted to intersect the still water surface 26. FIG. 1 further illustrates that the unit 10 comprises a deck structure 36 supported by the columns. Although a semi-submersible unit is used as an example when illustrating the present invention, it should be noted that the present invention is equally applicable to other types of units, such as ships, FPSOs or spar buoys (not shown).

Purely by way of example, the displacement of the unit 10 in an operational condition may be within the range of 10 000 to 300 000 metric tons. Again purely by way of example, the water depth, i.e. the distance from the sea bed to the still water surface, may be within the range of 50 to 3000 meters.

Figure 2:
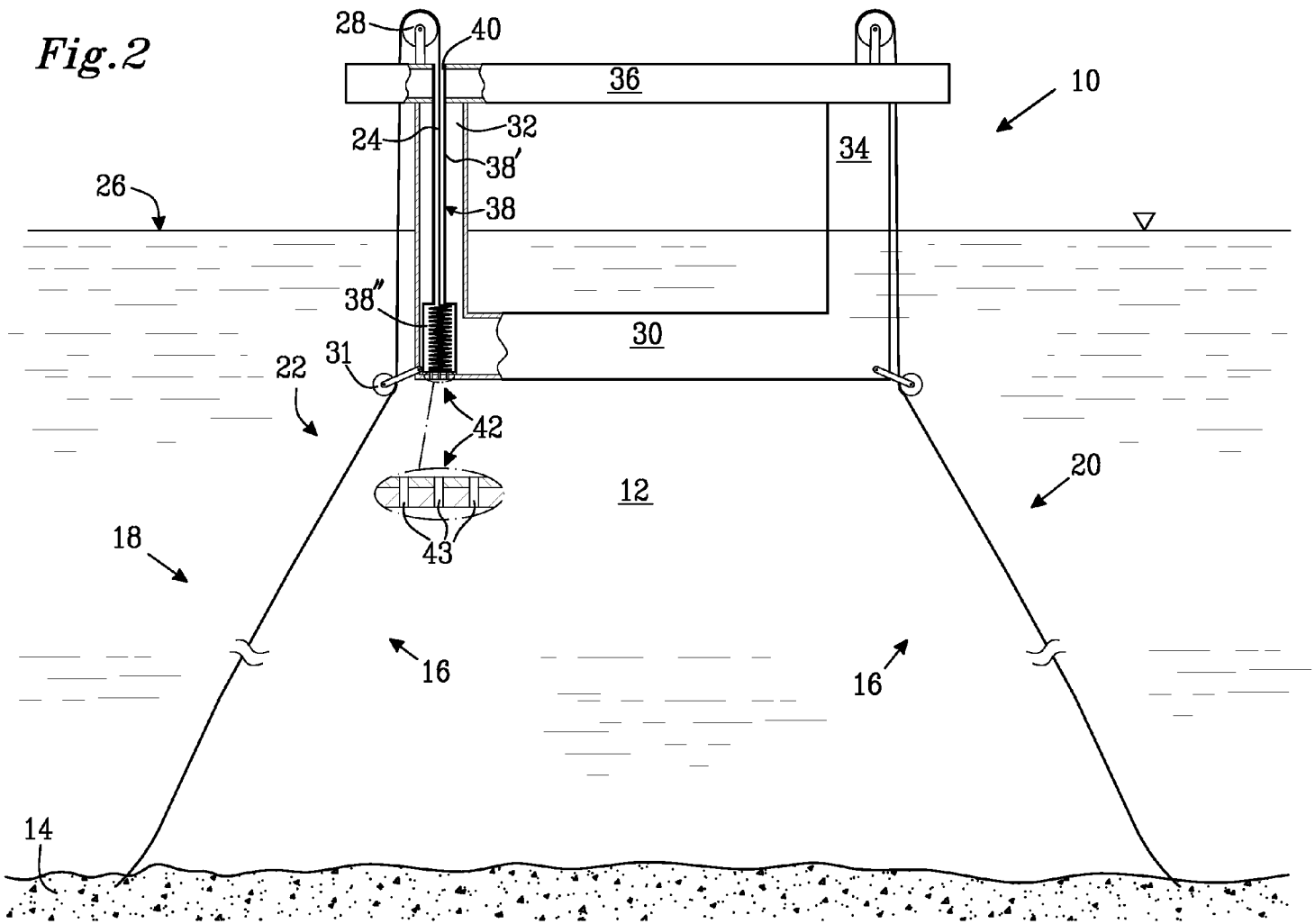
FIG. 2 is a schematic side view of a unit according to a further embodiment of the present invention.

FIG. 2 illustrates another embodiment of the present invention wherein the unit 10 comprises a cavity 38 through which at least a portion of the tail portion 24 extends when the unit 10 is floating. The FIG. 2 cavity 38 comprises an upper substantially cylindrical portion 38' which often is referred to as, a chain pipe or mooring line pipe. Moreover, the cavity 38 comprises a lower portion 38" which often is referred to as a chain locker or a mooring line locker.

FIG. 2 further illustrates that the mooring line handling arrangement 28—which in this case is the windlass—is located on the deck structure 36 of the unit. In other embodiments of the unit 10, the mooring line handling arrangement 28 may be a chain jack. It should also be noted that the unit 10 may not necessarily have to be equipped with one mooring line handling arrangement per mooring line. Instead the unit 10 may be provided with one or more mooring line handling arrangements common to some or all of the mooring lines and the more mooring line handling arrangements could thus be transported to and adapted to engage with a specific mooring line, should it be desired to alter the length of the connection portion of this particular mooring line. FIG. 2 also illustrates that the unit 10 comprises a fairlead 31 engaging with the connection portion 22 of the mooring line before the connection portion 22 reaches the mooring line handling arrangement 28.

According to the FIG. 2 embodiment of the present invention, the cavity 38 comprises a cavity inlet 40 and the cavity 38 is adapted to receive at least a portion of the tail portion 24 through the cavity inlet 40. As may be gleaned from FIG. 2, in the embodiment of the unit 10 disclosed therein, the cavity further comprises a cavity outlet 42 providing fluid communication between the cavity 38 and the environment ambient of the unit 10.

In the embodiment illustrated in FIG. 2, the fluid communication is provided such that there is a fluid communication between the cavity 38 and the body of water 12 when the unit 10 is floating in a permanent condition. In other words, the cavity outlet 42 is in FIG. 2 located below the still water surface 26. However, it is envisaged that other implementations of the cavity may provide a fluid communication between the cavity 38 and the air located above the still water level 26.

The above-mentioned fluid communication may be obtained in a plurality of ways. Purely by way of example, one or more ducts (not shown) may be located in the unit 10 connecting the cavity 38, preferably the lower portion 38" of the cavity, with the ambient environment. However, FIG. 2 illustrates a preferred implementation of the cavity wherein the lowermost delimitation of the lower portion 38" of the cavity 38 comprises a panel with a plurality of openings 43. This lowermost delimitation may additionally or instead comprise a grating on which at least a portion of the tail portion rests.

Instead of resting on a portion of the cavity 38 delimitation, the tail portion 24 may actually extend through the cavity outlet 42. Consequently, a portion of the tail portion 24 may extend downwards into the body of water 12. This possibility is illustrated in the FIG. 3 embodiment.

Figure 3:
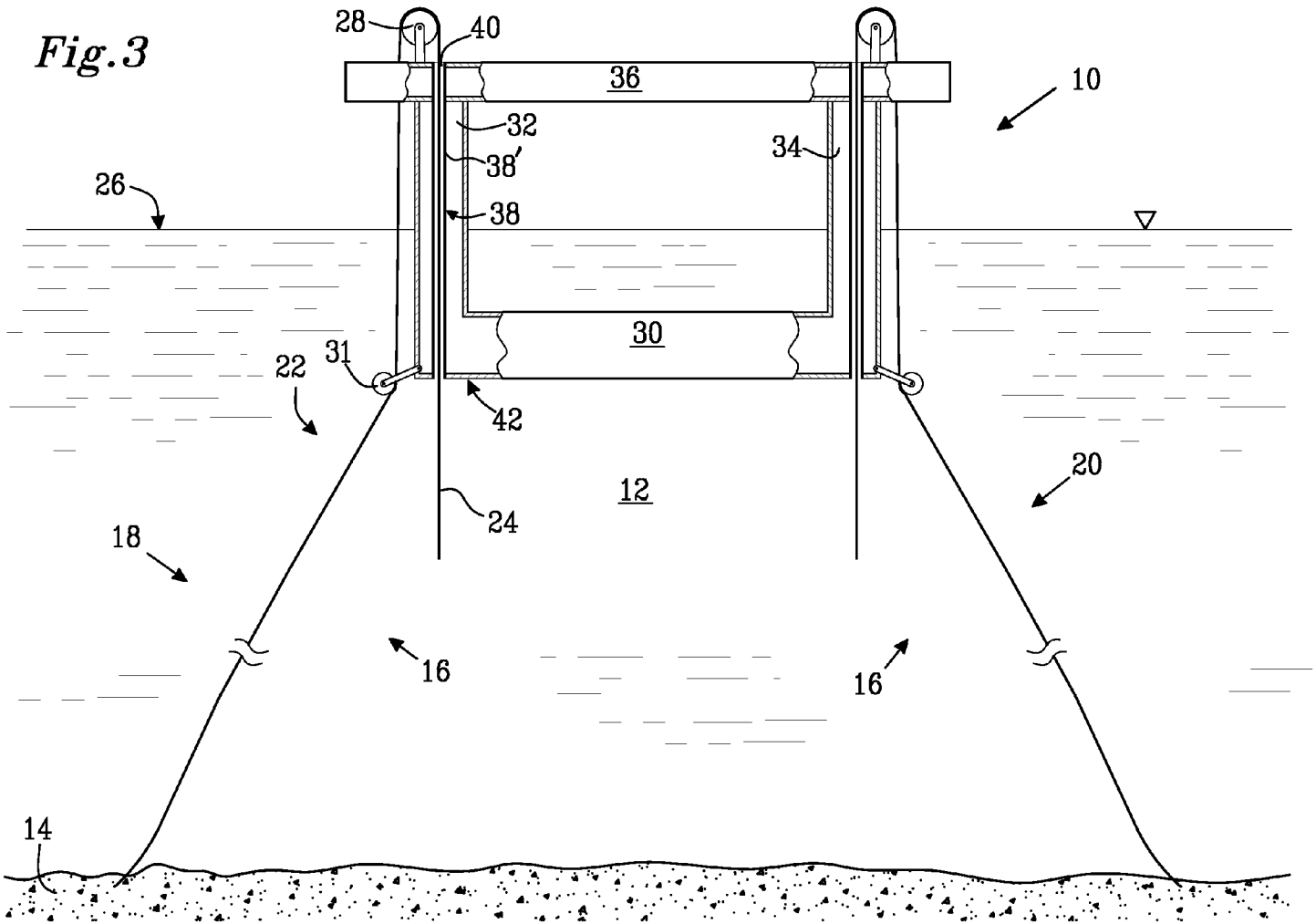
FIG. 3 is a schematic side view of a unit according to another embodiment of the present invention.

In both the FIG. 2 and FIG. 3 embodiments, the cavity 38 may be regarded as forming an integral part of the outer skin of the unit 10. Moreover, the cavity 38 extends through a portion of a column 32 as well as a portion of the float 30 both the FIG. 2 and FIG. 3 implementations. However, in other embodiments of the unit 10 of the invention, the cavity may extend through only a portion of a column (not shown) or only a portion of the float (not shown). Instead of, or in addition to, the above locations of the cavity 38, the cavity may in some further embodiments extend through a portion of the deck structure (not shown).

Figure 4:
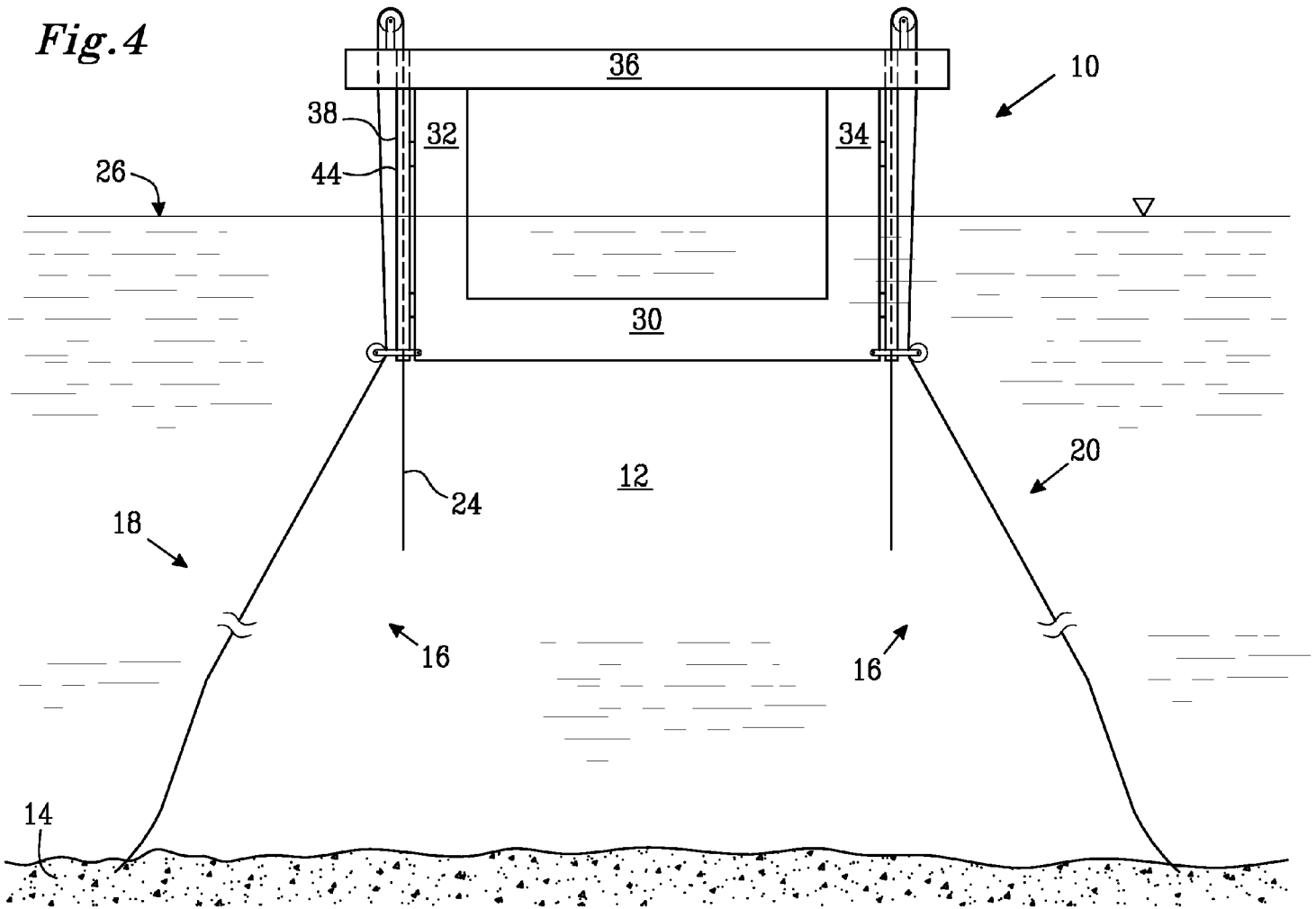
FIG. 4 is a schematic side view of a unit according to a further embodiment of the present invention.

FIG. 4 illustrates a further implementation of the cavity 38. As may be gleaned from FIG. 4, rather than extending through a portion of the unit's 10 hull, the cavity 38 is in the FIG. 4 implementation instead provided in a member attached to the hull. In the specific implementation illustrated in FIG. 4, the member is a tubular member 44.

Figure 5:
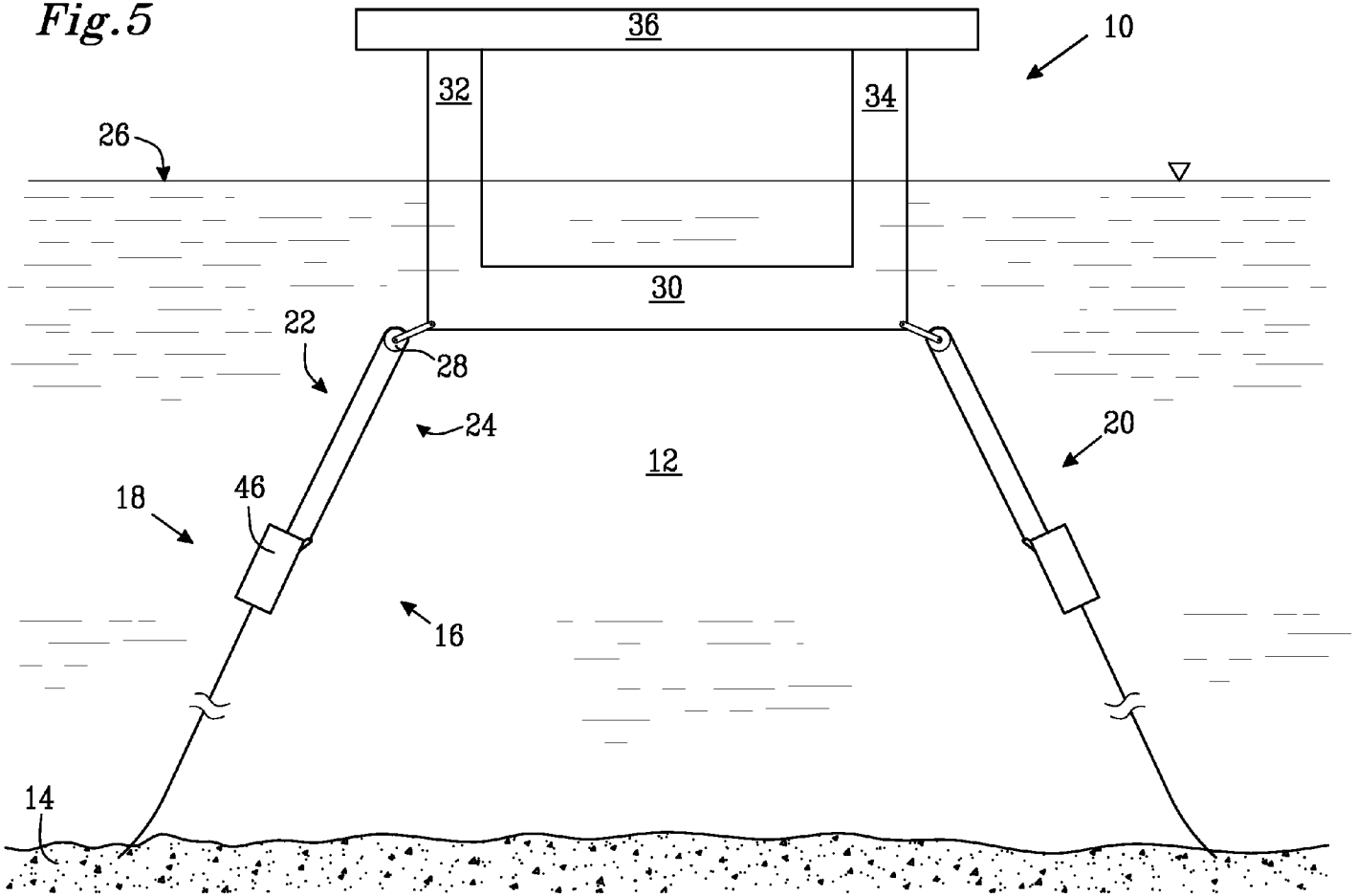
FIG. 5 is a schematic side view of a unit according to another embodiment of the present invention.

Finally, FIG. 5 illustrates a further embodiment of the unit 10 of the present invention in which the unit comprises a chaser 46 adapted to travel on the connection portion 22. As used herein, the expression "chaser" relates to a member which is adapted to at least partially circumvent a portion of the connection portion 22 in a manner such that the chaser is movable along the connection portion 22. Purely by way of example, the chaser may comprise a tubular member which may be threaded on the mooring line 18 prior to connecting the mooring line 18 to the mooring line handling arrangement.

Moreover, the tail portion 24 may be connected to the chaser 46 in a plurality of ways. Purely by way of example, the tail portion 24 may be welded to the chaser 46. Optionally, the chaser may be provided with a bracket and the tail portion 24 may be attached to the bracket by means of an attachment member, such as a clamp (not shown). The chaser 46 may also be used in the embodiments of the invention illustrated in FIG. 3 or FIG. 4.

Figure 6:
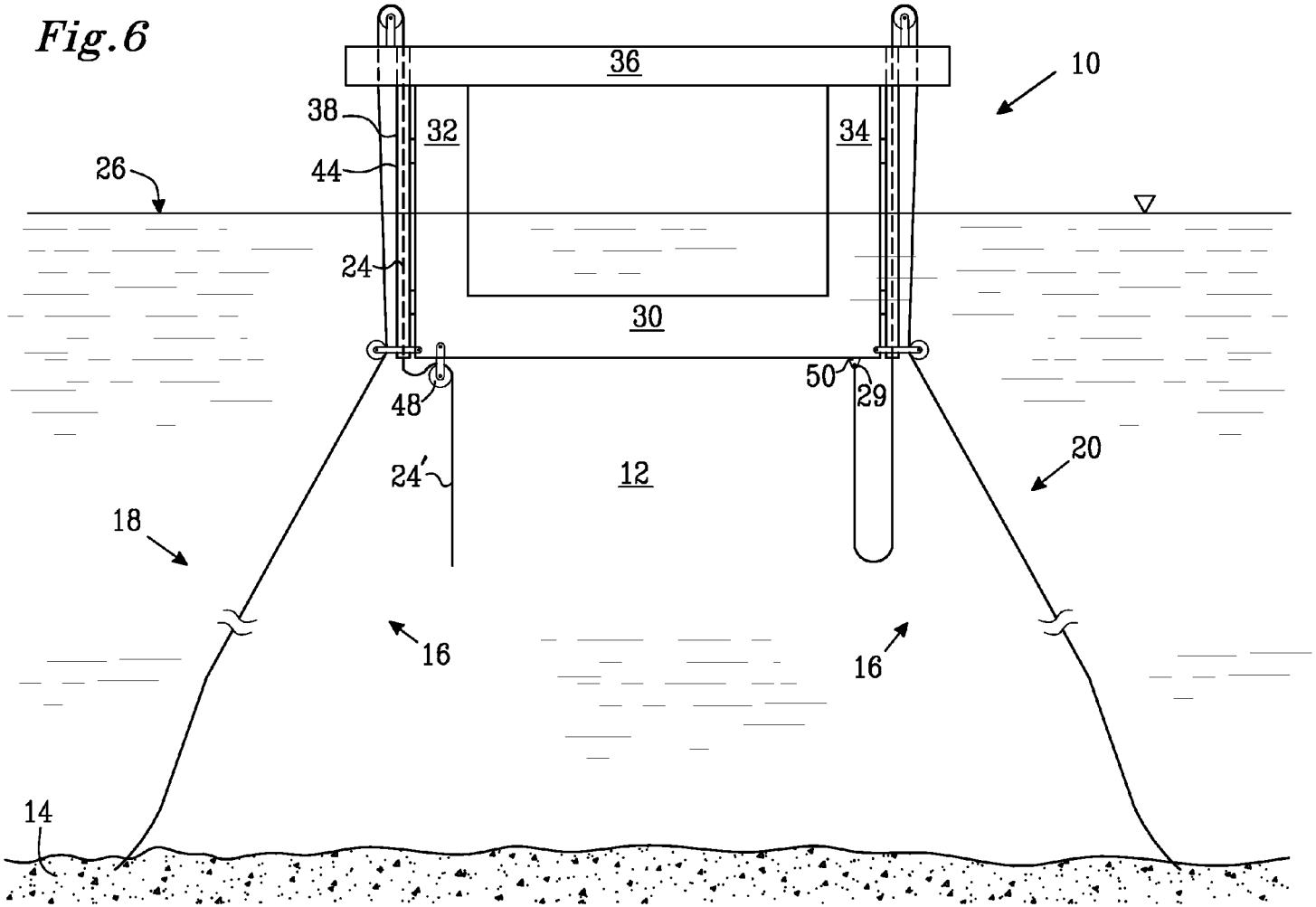
FIG. 6 is a schematic side view of a unit according to a further embodiment of the present invention.

FIG. 6 discloses a further embodiment of the present invention. As may be gleaned from FIG. 6, in addition to the features previously discussed in conjunction with the FIG. 4 embodiment, the FIG. 6 embodiment further comprises means to ensure that the point of attack of the weight of at least a portion of the tail portion 24 is located at a relatively low vertical level of the unit 10 (such means will hereinafter be considered to form part of a tail portion 24 load handling arrangement). To this end, the leftmost portion of the unit 10 comprises a pulley or roller 48 located at a low elevation of the unit 10, preferably beneath the keel of the unit 10. The tail portion 24 runs on the pulley 48 such that the lowermost portion 24' thereof is hung off from the pulley 48 as a consequence of which the point of attack of the weight of the lowermost portion 24' is the location of the pulley 48.

Alternatively, or in addition, the unit 10 may be provided with a bracket 50 to which the tail portion end 29 is attached, for instance by means of a bolt joint, in order to ensure that the tail portion 24 will not be dropped when hoisting the mooring line 20 (e.g. when slacking the mooring line 20). Although the pulley 48 and the bracket 50 are illustrated in separate implementations in FIG. 6, the pulley 48 and the bracket 50 may also be combined to form a further implementation of a tail portion 24 load handling arrangement (not shown). The above discussed implementations of the tail portion 24 load handling arrangements comprising a pulley 48 and/or bracket 50 may also be used in the FIG. 3 embodiment of the present invention.

As an alternative to the bracket 50 discussed hereinabove, the tail portion 24 may be prevented from falling into the sea by using a stop arrangement comprising a stop member (not shown) attached to the tail portion 24, preferably at the tail portion end 29 which stop member has an outer dimension which is larger than the outer dimension of the tail portion 24. The stop arrangement may further comprise an abutment member, for instance, in the cavity 38, against which the stop member may abut and thus be prevented from further upward movement. Purely by way of example, such an abutment member may comprise a constriction in the cavity 38 the inner dimension of which is smaller than the outer dimension of the stop member. Preferably, the abutment member may be located in the uppermost portion of the cavity 38, i.e in the portion closest to the mooring line handling arrangement 28.

Figure 7:
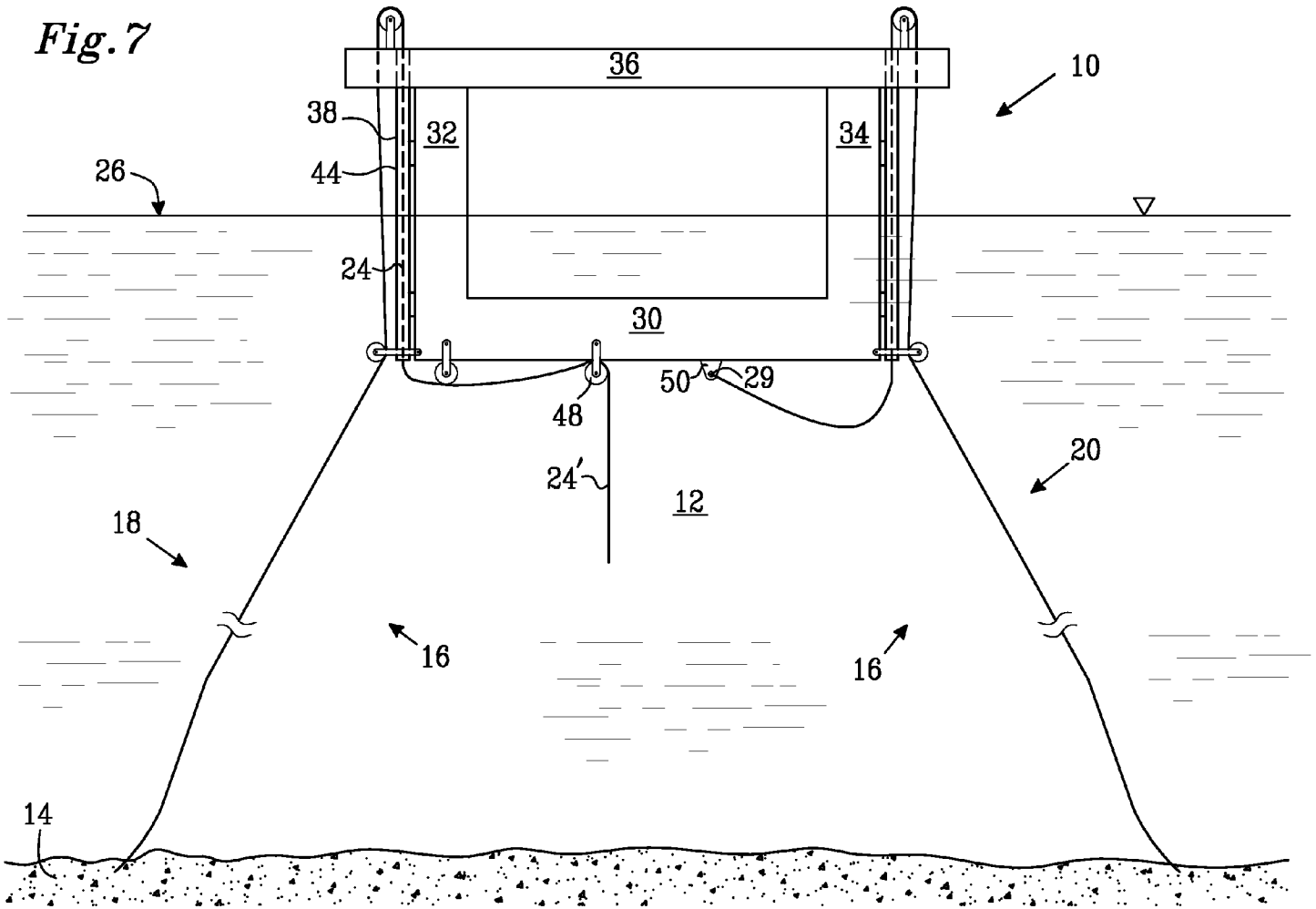
FIG. 7 is a schematic side view of a unit according to another embodiment of the present invention.

It should be noted that neither the pulley 48 nor the bracket 50 need to be located close to the corresponding cavity 38 or tubular member 44. Quite the contrary, in many implementations of the tail portion 24 load handling arrangement, it may be preferred that the pulley 48 and/or bracket 50 is located at a distance from the corresponding cavity 38 or tubular member 44, e.g. close to the center of a pontoon 30 as illustrated in FIG. 7. One advantage of such a position is that the free hanging length of the tail portion 24, i.e. the lowermost portion 24' thereof, is reduced which in turn, reduces the risk of e.g. clashing with other components of the unit 10 located in the body of water, such as risers, umbilicals or sea water inlet pipes (not shown in FIG. 7).

Figure 8:
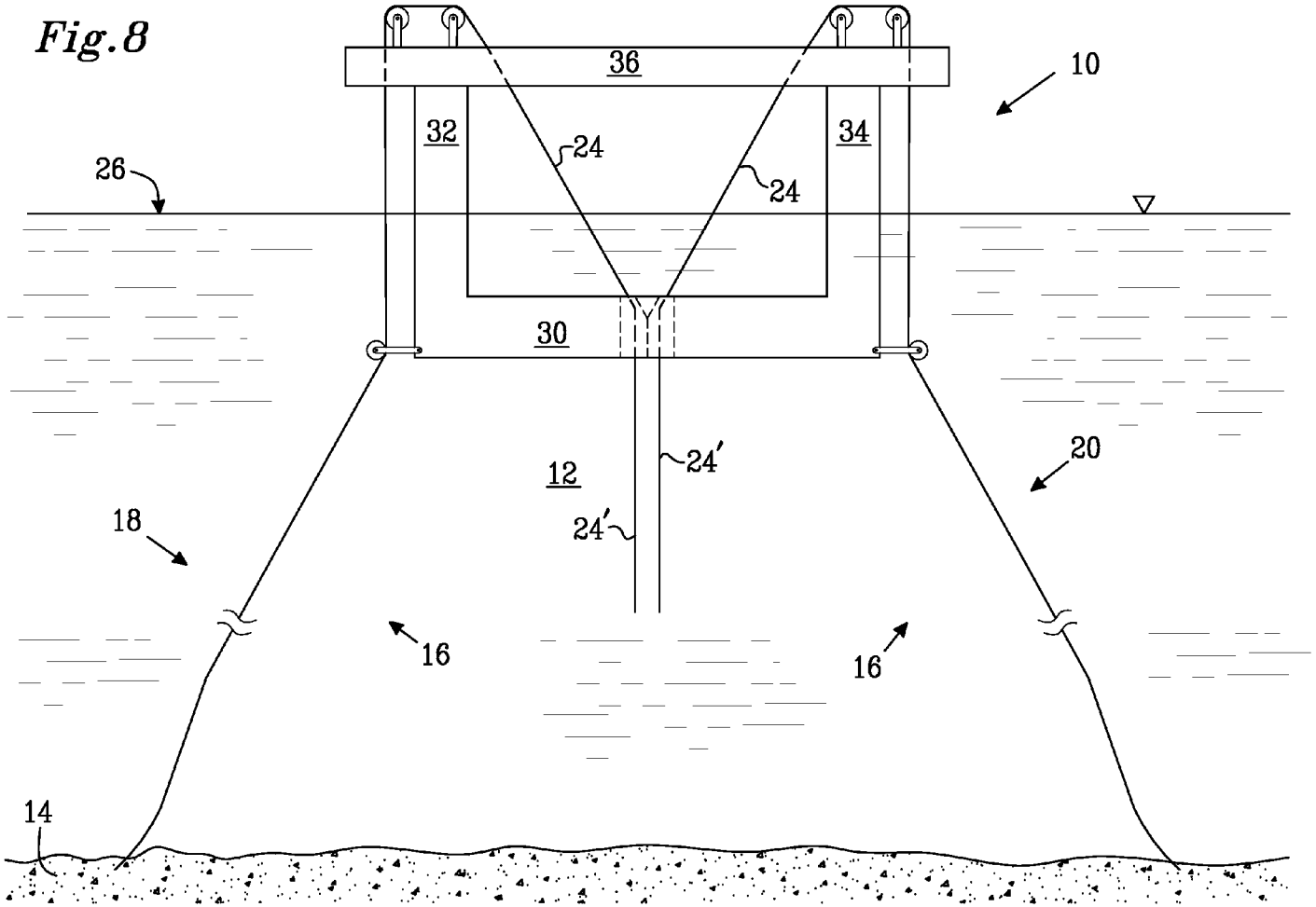
FIG. 8 is a schematic side view of a unit according to a further embodiment of the present invention.

FIG. 8 illustrates another embodiment of the present invention wherein the tail portions 24 are inclined so that the lowermost portion 24' of each tail portion 24 is located closer to the centre line of the unit 10 than the corresponding upper portion. In other words, at least one, preferably all, of the tail portions is inclined with respect to a vertical direction. One advantage of such an embodiment is that the lowermost portions 24' of each one of a plurality of tail portions 24 may be located adjacent to one another and preferably at a location where there is a low risk of e.g. clashing with other components of the unit 10 located in the body of water. The location indicated in the embodiment illustrated in FIG. 8 is close to the centre of the unit 10 although other locations may be preferred in other embodiments of the present invention.

Figure 9:
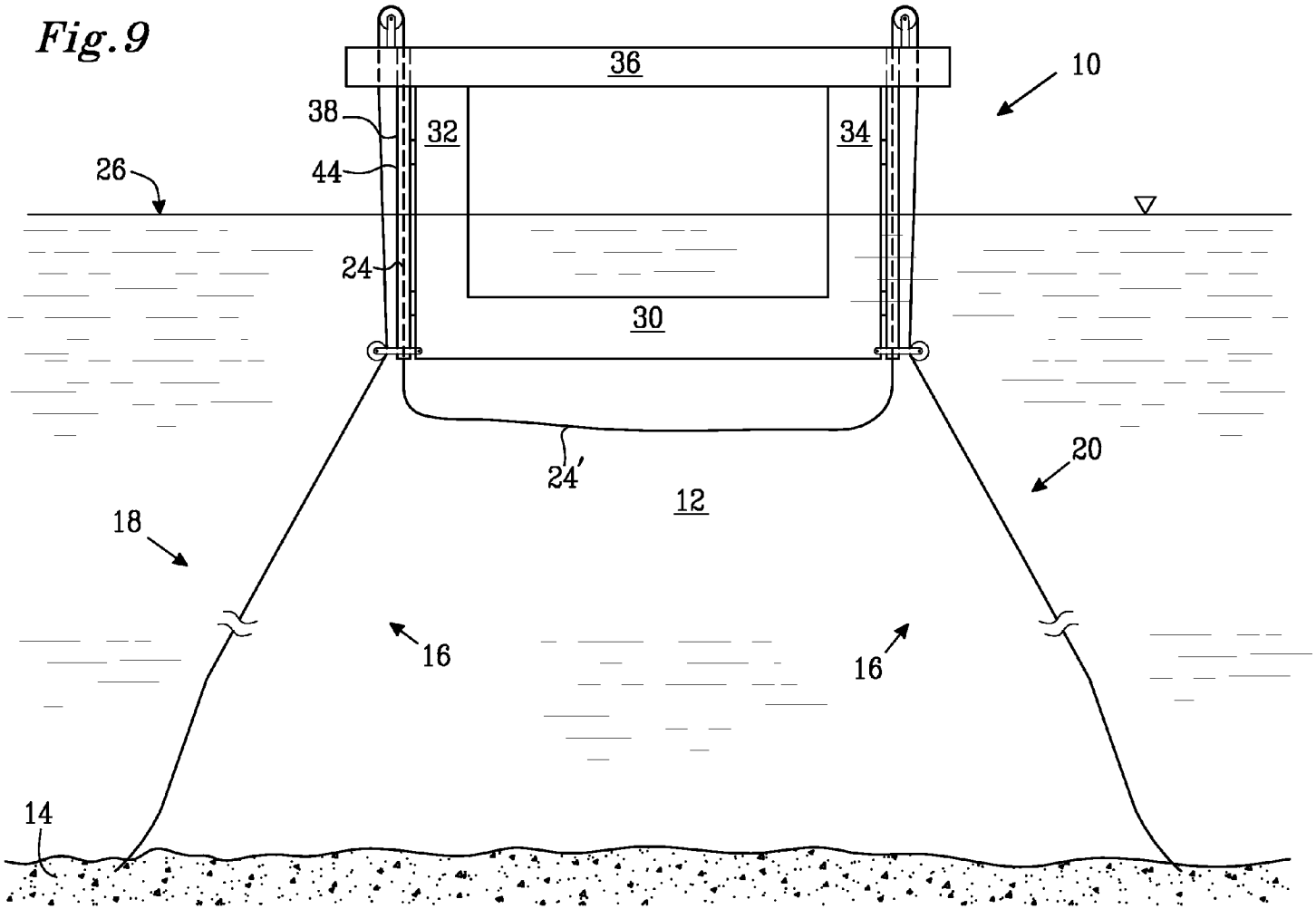
FIG. 9 is a schematic side view of a unit according to another embodiment of the present invention.

FIG. 9 illustrates a further embodiment of the present invention. In FIG. 9, the first mooring line 18 and the second mooring line 20 are connected to one another under the unit 10 such that the tail portion 24 of the first mooring line is connected to the tail portion 24 of the second mooring line 20. One advantage of the FIG. 9 embodiment is that the total length of the first and second mooring lines 18, 20 may be reduced since tightening of the first mooring line 18 is often carried out at the same time as a corresponding slacking of the second mooring line 20 (and vice versa). In a normal mooring, position, the lowermost portions 24' of the tail portions 24 are preferably located at a vertical distance from the bottom of the unit 10 (i.e. below the unit 10) in order to allow, that the unit 10 may be displaced in a direction in or out of the plane of FIG. 9. It should be noted that the above described connection of the tail portions of at least two mooring lines may be used for any one of the embodiments of the present invention illustrated in FIG. 1 or FIG. 3 to FIG. 7. Moreover, in further embodiments of the present invention, the first and second mooring lines 18, 20 may instead be connected to one another above the deck structure 36 such that one continuous mooring line is obtained which extends from the sea bed, over the unit 10 and then back again to the sea bed. Furthermore, in other embodiments of the present invention, the first and second mooring lines may be connected to one another on a level between the deck structure 36 and the unit's keel.

Figure 10:
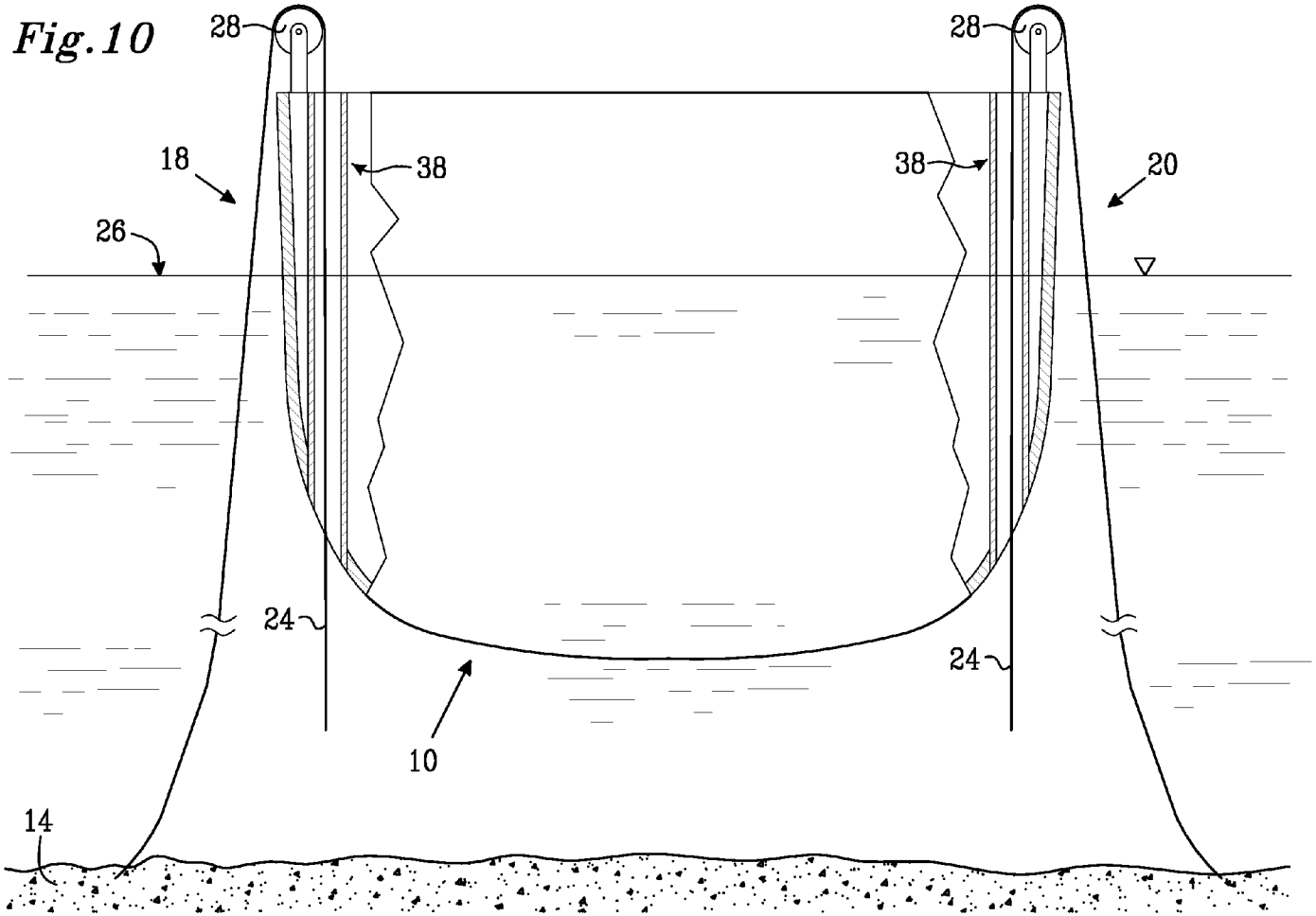
FIG. 10 is a schematic side view of a unit of a FPSO type according to a further embodiment of the present invention.

FIG. 10 illustrates a cross-section of another embodiment of the present invention wherein the floating unit 10 is a FPSO (Floating Production Storage and Offloading) unit 10 or a FPO (Floating Production and Offloading) unit 10. The FIG. 10 embodiment comprises a plurality of mooring lines only two of which 18, 20 are visible in FIG. 10. As may be gleaned from FIG. 10, a portion of each one of the two mooring lines 18, 20 may extend through a corresponding cavity 38 each one of which in turn extends through the unit's 10 hull.

The mooring lines 18 according to any one of the embodiments of the unit 10 illustrated in FIG. 1 to FIG. 10 may be connected to the unit 10 by a method which comprises the steps of:

connecting a portion of a mooring line 18 to the sea bed;

connecting the mooring line 18 to the mooring line handling arrangement 28 such that a connection portion 22 of the mooring line is obtained between the mooring line handling arrangement 28 and the sea bed 14 and a tail portion 24 of the mooring line is obtained on the opposite side of the mooring line handling arrangement 28 as compared to the connection portion 22, and arranging the tail portion 24 in a permanent storage position such at least a portion of the tail portion 24 end is located in the body of water 24.

The above step of connecting a portion of the mooring line 18 to the sea bed 14 may preferably comprise a step of connecting a portion of the connection portion 22 to an anchor (not shown) attached to the sea bed.

As such, it should be realized that the present invention is not limited to the embodiments described hereinabove and illustrated in the drawings. For instance, although mooring lines comprising segments of chains and wires have been used in the above embodiments, the present invention is also useful for mooring lines comprising segments of other types, such as polyester ropes. Accordingly, a person skilled in the art will realize that many changes and modifications may be performed within the scope of the appended claims.

The invention claimed is:

1. A unit adapted to float in a body of water, comprising:

a station-keeping system comprising a mooring line, said mooring line comprising a connection portion and a tail portion and, when the unit is floating, said body of water reaches a still water line of said unit and said connection portion extends from a sea bed to a mooring line handling arrangement of said unit, said handling arrangement actively alters the length of said connection portion characterized in that when said mooring line is in a mooring position, at least a portion of said tail portion extends downward into said body of water, wherein said unit comprises a chaser, surrounding said connection portion, that travels over said connection portion, at least a portion of said tail portion being directly fixed to said chaser, and wherein said tail portion extends to said mooring line handling arrangement.

2. The unit according to claim 1, wherein said tail portion comprises a tail portion end at which said tail portion terminates and, when said mooring line is in the mooring position, said tail portion end is located in said body of water, above said sea bed.

3. The unit according to claim 1, wherein said unit further comprises a cavity through which at least a portion of said tail portion extends when the unit is floating.

4. The unit according to claim 1, wherein said mooring line handling arrangement is at least partially located below said still water surface.

5. The unit according to claim 1, wherein said unit comprises a float adapted to be located under said still water surface, said unit further comprising a plurality of support columns, each one of which extending from said float and being adapted to intersect said still water surface.

6. A unit adapted to float in a body of water, comprising:

a mooring line handling arrangement that handles at least one mooring line for the purpose of station-keeping of the unit, said handling arrangement actively interacts with said mooring line such that a connection portion of said mooring line extends from said arrangement to said sea bed; and a tail portion of said mooring line located on the opposite side of said arrangement as compared to said connection portion, wherein said handling arrangement actively alters the length of said connection portion, said unit comprising a cavity that receives at least a portion of said tail portion through a cavity inlet, such that said cavity further comprises a cavity outlet providing fluid communication between said cavity and the environment ambient of said unit, wherein said unit further comprises a chaser, surrounding said connection portion, that travels over said connection portion, at least a portion of said tail portion being directly fixed to said chaser, and wherein said tail portion extends to said mooring line handling arrangement.

7. The unit according to claim 6, wherein said cavity outlet is located below said still water surface.

8. The unit according to claim 6, wherein said cavity forms an integral part of an outer skin of the unit.

9. The unit according to claim 6, wherein said unit comprises a float adapted to be located under said still water surface, said unit further comprising a plurality of support columns, each one of which extending from said float and being adapted to intersect said still water surface, said cavity being at least partially accommodated in at least one of said support columns.

10. The unit according to claim 9, wherein said cavity further extends through at least a portion of said float.

11. A method for obtaining a station-keeping system for a unit floating in a body of water, said unit comprising:

a mooring line handling arrangement that handles a mooring line for the purpose of station-keeping of the unit, said handling arrangement actively alters the length of a connection portion of said mooring line, wherein said method comprises the steps of:

connecting a portion of a mooring line to a sea bed;

connecting said mooring line to said mooring handling arrangement such that said connection portion is obtained between said mooring line handling arrangement and said sea bed and a tail portion of said mooring line is obtained on the opposite side of said mooring line handling arrangement as compared to said connection portion, and arranging said tail portion in a storage position such that at least a portion of said tail portion extends downward into said body of water, wherein said unit comprises a chaser, surrounding said connection portion, that travels over said connection portion, at least a portion of said tail portion being directly fixed to said chaser, and wherein said tail portion extends to said mooring line handling arrangement.

12. The unit according to claim 1, wherein said tail portion extends downward into said body of water at a location between said unit and said sea bed.

13. The unit according to claim 1, wherein at least a portion of said tail portion is disposed beneath said unit.

14. The unit according to claim 6, wherein at least a portion of said tail portion is disposed beneath said unit.

15. The unit according to claim 6, wherein at least a portion of said tail portion rests on a grating disposed in said body of water.

16. The unit according to claim 6, wherein said cavity is in fluid communication with said body of water via one or more ducts.

17. The method according to claim 11, wherein said tail portion extends downward into said body of water at a location between said unit and said sea bed.

18. The method according to claim 11, wherein at least a portion of said tail portion is disposed beneath said unit.

* * * * *